US006899411B2

(12) United States Patent
Niikura et al.

(10) Patent No.: US 6,899,411 B2
(45) Date of Patent: May 31, 2005

(54) RECORDING APPARATUS

(75) Inventors: Takeji Niikura, Kanagawa (JP); Seiji Ogasawara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 68 days.

(21) Appl. No.: 10/427,976

(22) Filed: May 2, 2003

(65) Prior Publication Data

US 2004/0027441 A1 Feb. 12, 2004

(30) Foreign Application Priority Data

May 9, 2002 (JP) ..... 2002-133754

(51) Int. Cl.[7] ..... B41J 2/165
(52) U.S. Cl. ..... 347/22
(58) Field of Search ..... 347/22, 29–33, 347/35, 36, 55, 102, 104, 105; 101/216; 400/636

(56) References Cited

U.S. PATENT DOCUMENTS 6,239,817 B1 5/2001 Meyer ..... 367/36
6,428,149 B1 * 8/2002 Mizuyama et al. ..... 347/55
6,666,136 B2 * 12/2003 Lee ..... 101/216

FOREIGN PATENT DOCUMENTS

JP 2002-118058 4/2000

* cited by examiner

*Primary Examiner*—Shih-Wen Hsieh
(74) *Attorney, Agent, or Firm*—Fitzpatrick, Cella, Harper & Scinto

(57) ABSTRACT

The present invention relates to a recording apparatus for recording an image by discharging an ink, and including a recording head capable of recording to at least one edge of recording medium without any margin, a receiving portion for receiving ink droplets discharged at a position extending beyond the edge of the recording medium, and a conveyance rotary body located at an upstream side of the receiving portion with respect to a conveyance direction of the recording medium. The conveyance rotary body is made conductive to an apparatus body.

11 Claims, 9 Drawing Sheets

RECORDING APPARATUS

BACKGROUND OF THE INVENTION

1. Field of the Invention

This invention relates to a recording apparatus capable of recording up to at least one edge of a recording medium with no margin.

2. Related Background Art

Referring to FIG. 8 and FIG. 9, a prior art recording apparatus will be described. Conventionally, in a recording apparatus capable of recording with no margin at edges of a recording medium, such as a sheet or the like, an ink-jet recording apparatus capable of recording with no margin has been known to have a structure in which an opening is formed in a sheet passing surface of a platen 6 for holding the sheet at a recording position, in which a recess 26 made of vertical surfaces and a bottom surface is formed below the opening, and in which ink absorbing materials (hereinafter, referred to as "platen ink absorbing material 27") are provided in the recess 26. Such a concrete structure is disclosed in JP-A-2000-118058.

With this inkjet recording apparatus, a gap of a predetermined distance is formed between the back side of the sheet and the platen ink absorbing material 27 to prevent the sheet from getting stained due to contact therewith. Therefore, if recording is made to a position extending beyond an edge of the sheet to achieve recording with no margin with respect to edges of the sheet, the sheet may be stained with discharged ink droplets that float around the back side of the sheet. This staining is more common on sheets that are electrostatically charged from, for example, friction between the sheets or friction between the sheets and the feeding roller.

To solve this problem, a structure is devised in which a discharging brush made of, for example, fine metal bristles or carbon bristles, is arranged on an upstream side of the recording section to remove electrostatic charges from the sheets electrostatically charged during sheet feeding or the like. With this prior art structure, however, the discharging brush described above must be of a minimum width and is necessarily in grounded connection with a chassis member of the apparatus to remove the electric charges from the sheets, so that the structure inevitably results in greatly increased costs.

With respect to the above situation, an apparatus with an inexpensive structure for preventing the back side of the sheet from being stained is sought.

SUMMARY OF THE INVENTION

This invention intends to solve the above problems in the prior art. It is an object of the invention to provide a recording apparatus capable of recording with no margin at edges with an inexpensive structure for preventing the back side of the sheet from being stained.

A representative structure of the invention for achieving the above object is a recording apparatus for recording an image by discharging an ink including: a recording means capable of recording to at least one edge of a recording medium without any margin; an opening for ink droplets discharged at a position extending beyond an edge of the recording medium; and a conveyance rotary body located on an upstream side of the opening with respect to a conveyance direction of the recording medium, wherein the conveyance rotary body is made conductive to an apparatus body.

For example, the conveyance rotary body located on the upstream side of the opening with respect to the recording medium conveyance direction may be made conductive to the chassis of the apparatus body with a plate shaped conductor, or may be made conductive to the chassis of the apparatus body with a bearing member of the conveyance rotary body.

With the above structure, because it is unnecessary to specially form a member for discharging static electricity from the electrostatically charged recording medium, the static electricity charged at the recording medium can be made to escape effectively from the conveyance rotary body even though the structure is inexpensive, thereby preventing the recording medium from being stained due to attachment of ink droplets discharged beyond an edge of the recording medium to the back side of the electrostatically charged recording medium.

DETAILED DESCRIPTION OF THE PREFERRED EMBODIMENTS

Figure 1:
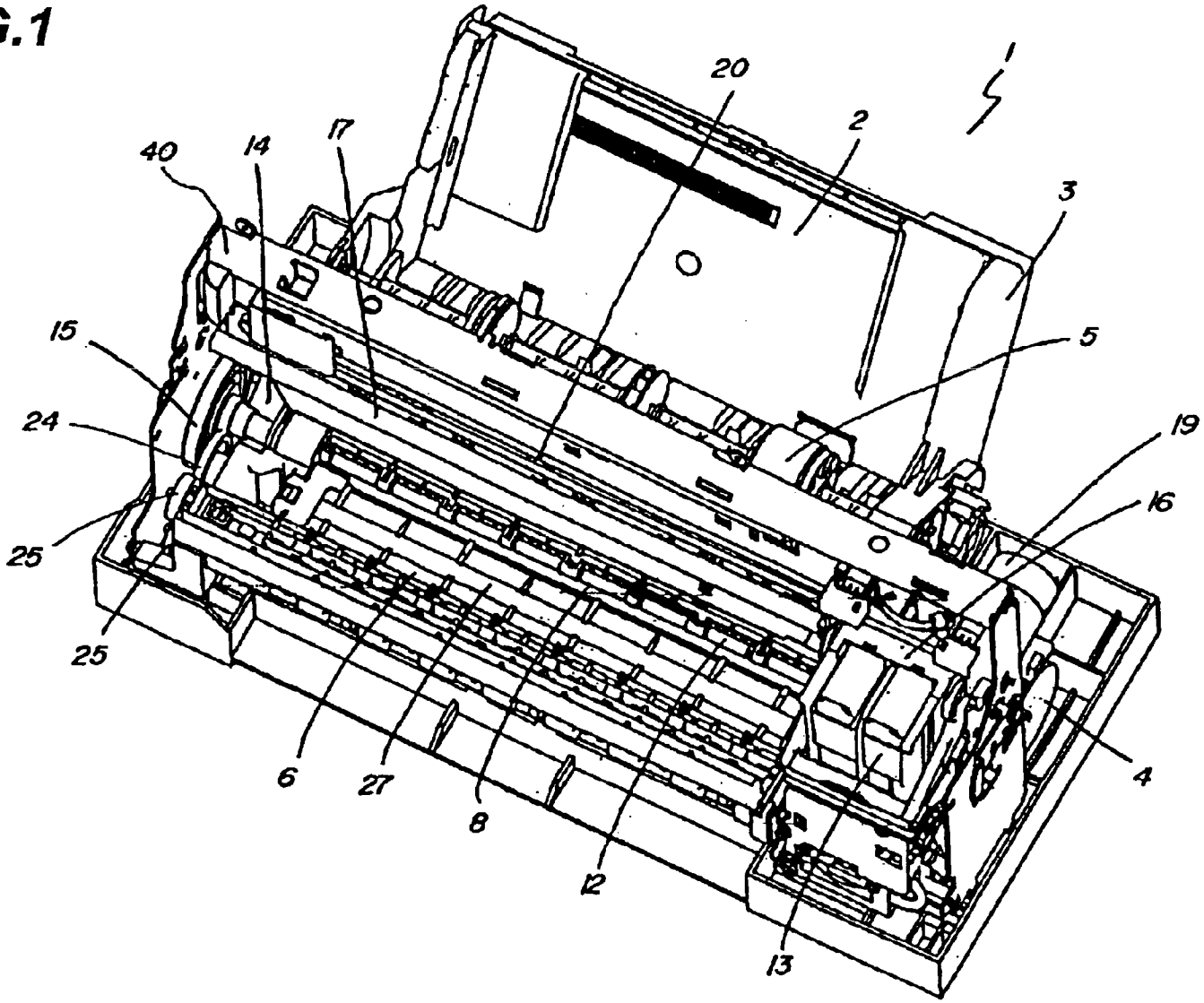
FIG. 1 is a perspective view showing an inkjet recording apparatus according to an embodiment of the invention.

Hereinafter, referring to the drawings, preferred embodiments according to the invention will be described in detail in an exemplifying manner. Such sizes, materials, shapes, and correlative positions of structural parts as set forth in the following embodiments can be modified according to the apparatus structure and various conditions to which this invention applies, and the scope of the invention is not intended to be limited to such so long as no special description is provided.

[First Embodiment]

Hereinafter, a recording apparatus according to the first embodiment will be described with reference to FIG. 1 through FIG. 7. It is to be noted that in this embodiment an inkjet printer is exemplified as a recording apparatus for description.

First, an outline of the entire structure of the apparatus and operation of recording with no margin will be described.

As shown in FIG. 1, a pressing plate 2 of a feeding apparatus 1 is pivotally supported by a feeding apparatus frame 3, and sheet bundles are stacked on a top face of the pressing plate 2. During sheet feeding, a feeding roller 5 rotates in association with a feeding motor 4 as a drive source, and the pressing plate 2 moves pivotally toward the feeding roller 5 with the aid of a pressing plate spring 7 (see FIG. 2) to press the sheet bundle to the feeding roller 5. When the feeding roller 5 further rotates, only the topmost sheet of the sheet bundle is separated and fed downstream.

The sheet separated and fed by the feeding apparatus 1 is fed to a conveyance roller 8 according to further rotation of the feeding roller 5. The conveyance roller 8 has a structure in which ceramic particles are coated together with a binder material at around 30 $\mu$m on a surface of a metal shaft to maintain a proper frictional coefficient for conveying a sheet as a recording medium and in which the binder material is formed with pin holes when coated.

Figure 2:
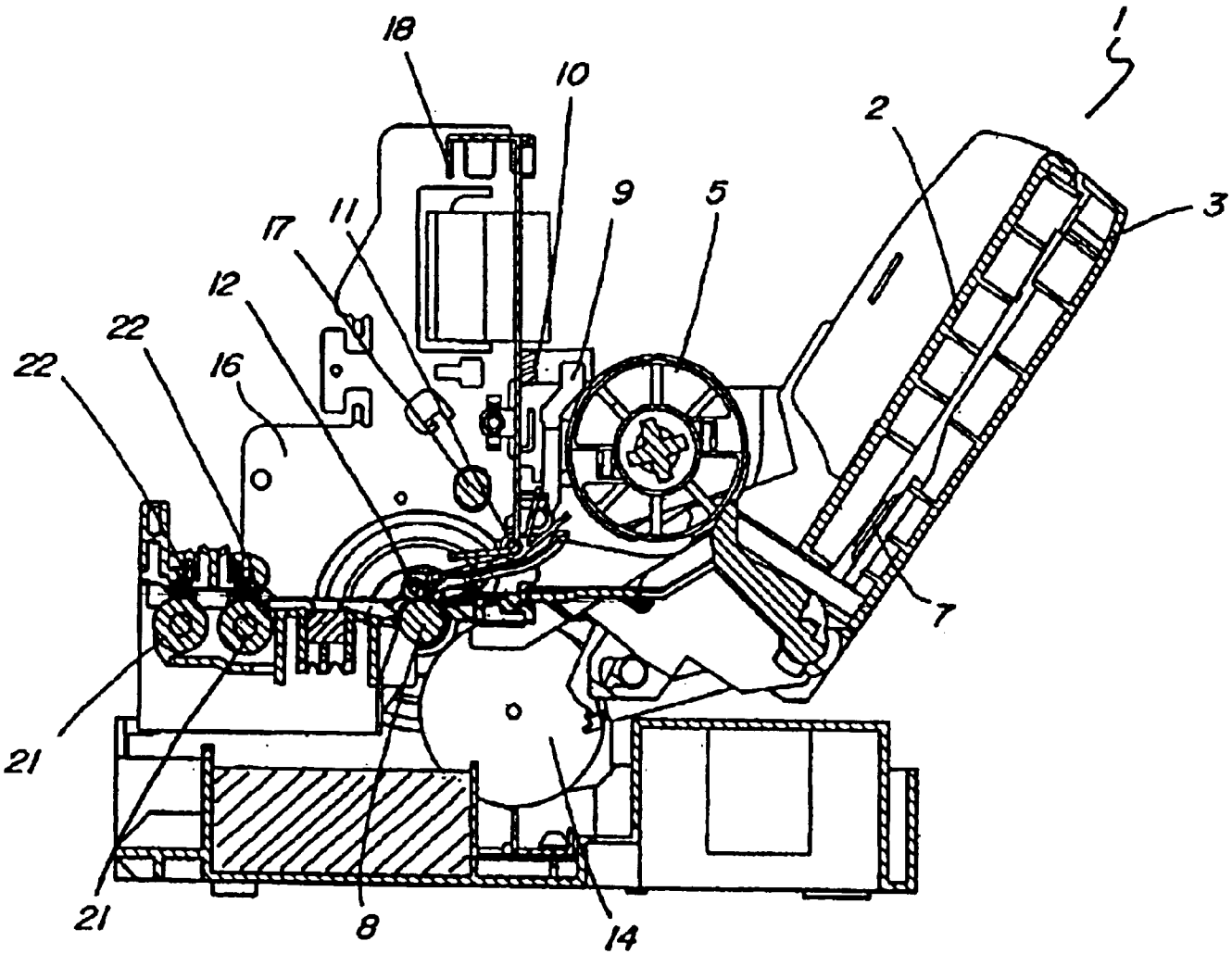
FIG. 2 is a side cross-sectional view showing the inkjet recording apparatus according to the embodiment of the invention.

In FIG. 2, when the front end of the sheet separately fed from the feeding apparatus 1 pushes a sensor lever 9 disposed between the feeding roller 5 and the conveyance roller 8, the sensor lever 9 is pivotally moved, and when the sensor lever 9 moves beyond a sheet sensor 10, the front end of the sheet is detected. The rear end of the sheet is detected by return of the sensor lever 9 to the sheet sensor 10.

The sheet is conveyed in a prescribed amount with the feeding roller 5 on the basis of the detected results of the front end of the sheet described above, and enters a nipping portion formed of a contact between the conveyance roller 8 and a pinch roller 12 urged to the conveyance roller 8 by a pinch roller spring 11. The sheet is further conveyed in a prescribed amount by the feeding roller 5 to curve the front end of the sheet, thereby pushing the front end of the sheet to the nipping portion, and rendering a registration operation completed.

After the completion of the registration operation, the sheet is conveyed on a platen 6 by the conveyance roller 8, and is supported by the top surface of the platen 6 at a position in opposition to a surface of ink discharging nozzles of a mounted recording head 13 serving as a recording means. The conveyance roller 8 is rotated via a conveyance roller gear 15 by a stepping motor 14 as a drive source.

Images are subsequently formed upon scanning a carriage 16 across the sheet supported on the top surface of the platen 6 while discharging ink droplets from the recording head 13 mounted detachably on the carriage 16. The carriage 16 is supported for scanning by a guide rail 18 and a parallel guide shaft 17, and a metal chassis 40 of the apparatus body, and is driven via a timing belt 20 by drive from a carriage motor 19.

It is to be noted that the inkjet recording method is used in which ink is discharged from the recording head as described above as a means for recording in this apparatus. That is, this recording head has plural fine orifices, a fluid route, an energy operation section formed at a part of the fluid route, and an energy generating means for generating energy to be applied to fluid in the operating section for producing droplets.

As an energy generating means for generating such energy, exemplified are electromechanical converters such as piezo devices, energy generating means discharging droplets by application of generated heat from radiation of electromagnetic waves such as from a laser or the like, or energy generating means discharging fluid upon heating the fluid with an electro-thermal converter such as a heat generating resistor.

A recording head used for the inkjet recording method in which fluid is discharged by thermal energy, among those discussed above, is able to effect high resolution recording because the orifices for discharging the droplets for recording can be arranged at a high density. A recording head using the electro-thermal converter as an energy generating means, among those discussed above, advantageously can be readily made compact, readily mounted at a high density, and made with reduced manufacturing costs.

It is to be noted that in this embodiment, as a discharging structure of the ink, recording is effected by energizing the electro-thermal converter in accordance with a recording signal and by growing and contracting bubbles generated in the ink by utilizing film boiling occurring in the ink from the thermal energy to discharge the ink out of the orifices.

Figure 3:
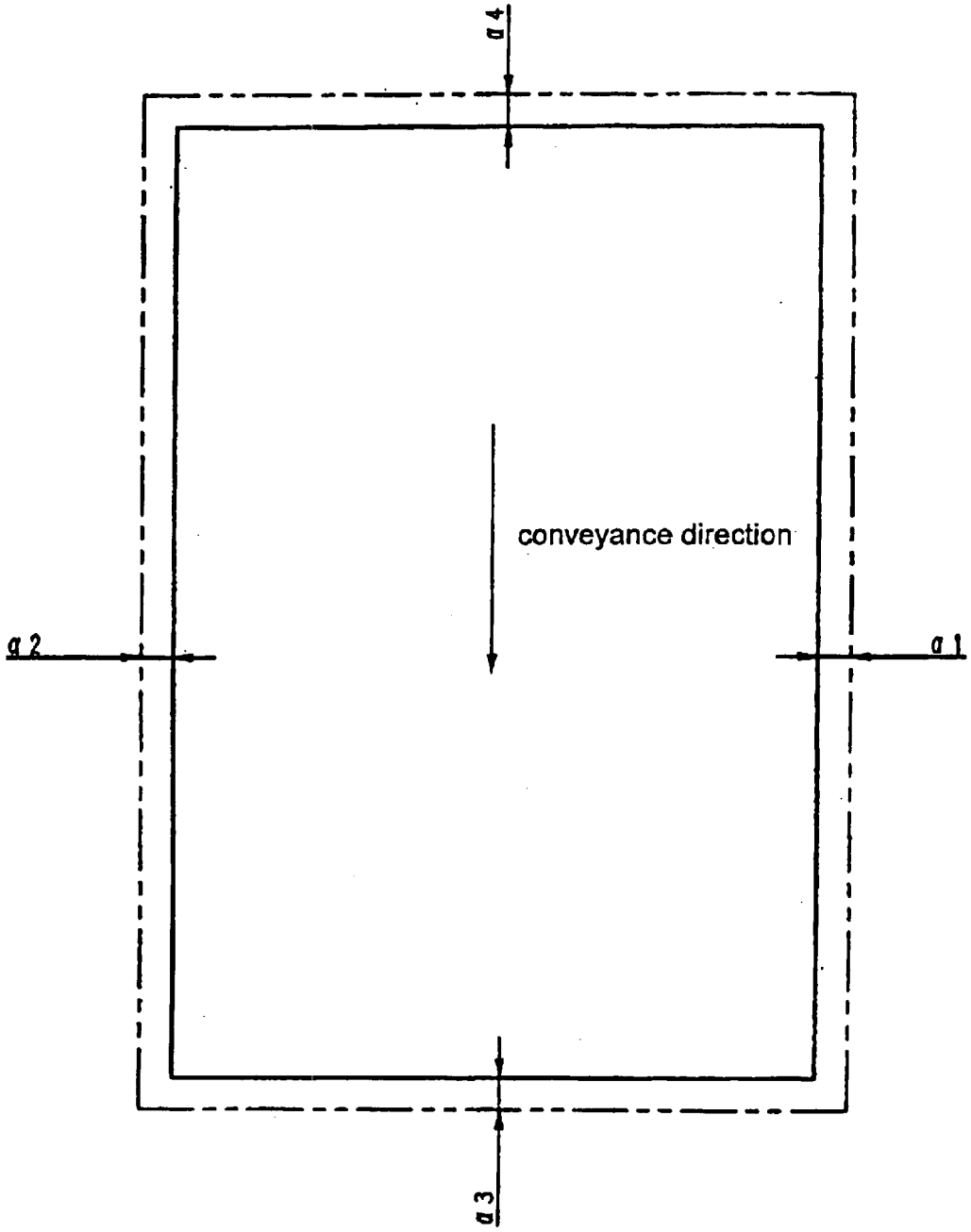
FIG. 3 is a schematic diagram showing an image forming range during recording with no margin at edges of the recording medium.

When recording with no margin is to be effected on a sheet, such recording with no margin is realized by recording up to prescribed amounts a1 to a4 in a manner shown with a double dotted chain line from four sheet edges with respect to an actual sheet shown with a solid line in FIG. 3. The prescribed amounts a1 to a4 are set in consideration of sheet conveyance accuracy and sheet cutting accuracy, and, in fact, a distance of 2 to 3 mm is proper.

Finally, the sheet on which the image formation is completed is delivered to the exterior of the apparatus by delivery rollers 21 and driven spurs 22 pushed to the delivery rollers 21 with spur springs (not shown). The delivery rollers 21 are rotated via the conveyance roller gear 15, an intermittent gear 24, and a delivery roller gear 25 by the stepping motor 14 as a drive source.

Next, a structure of an opening for the platen 6 for holding a platen ink absorbing material 27 will be described.

Figure 4:
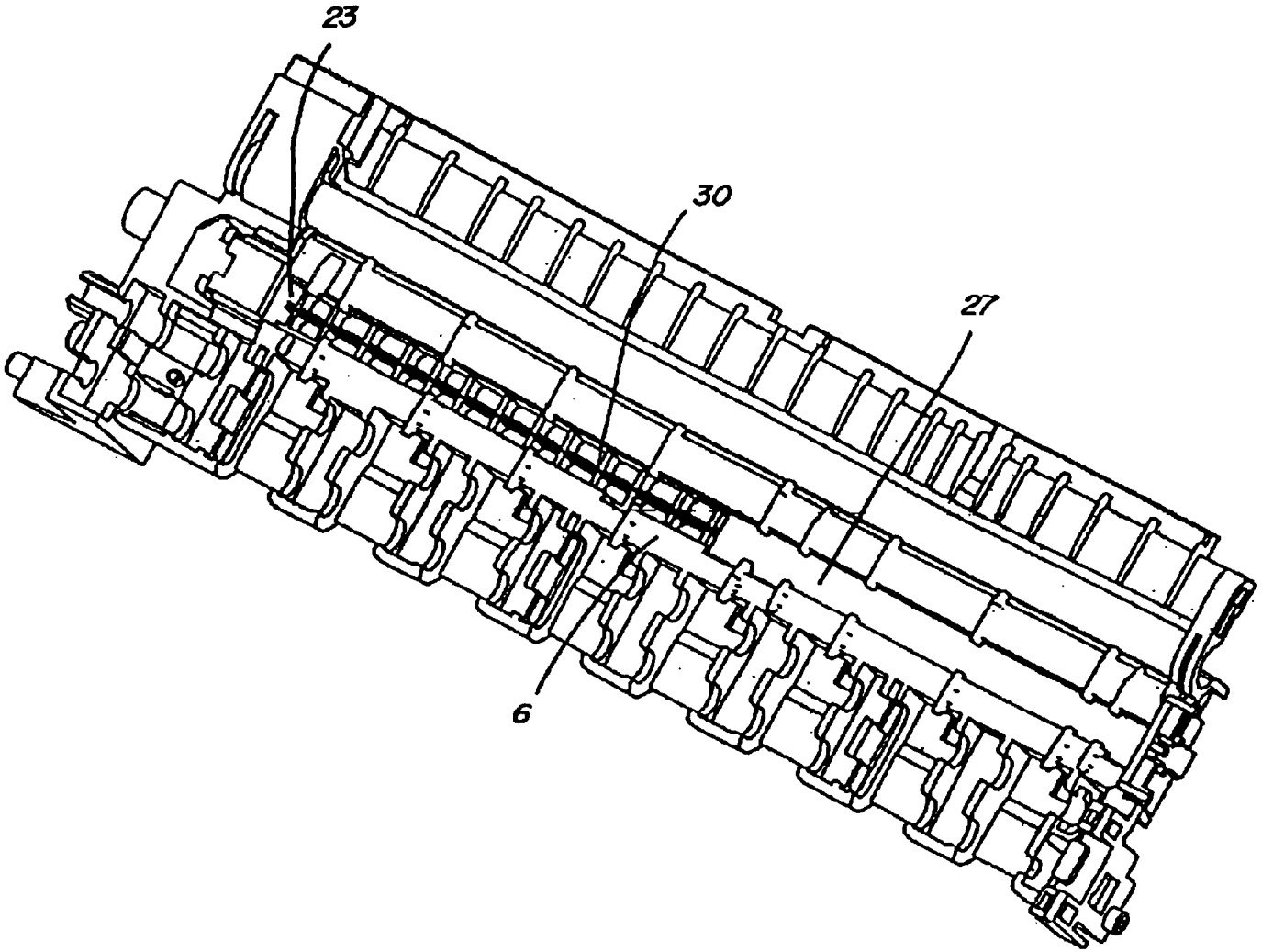
FIG. 4 is a perspective view showing a portion of the apparatus for recording with no margin in the embodiment of the invention.
Figure 5:
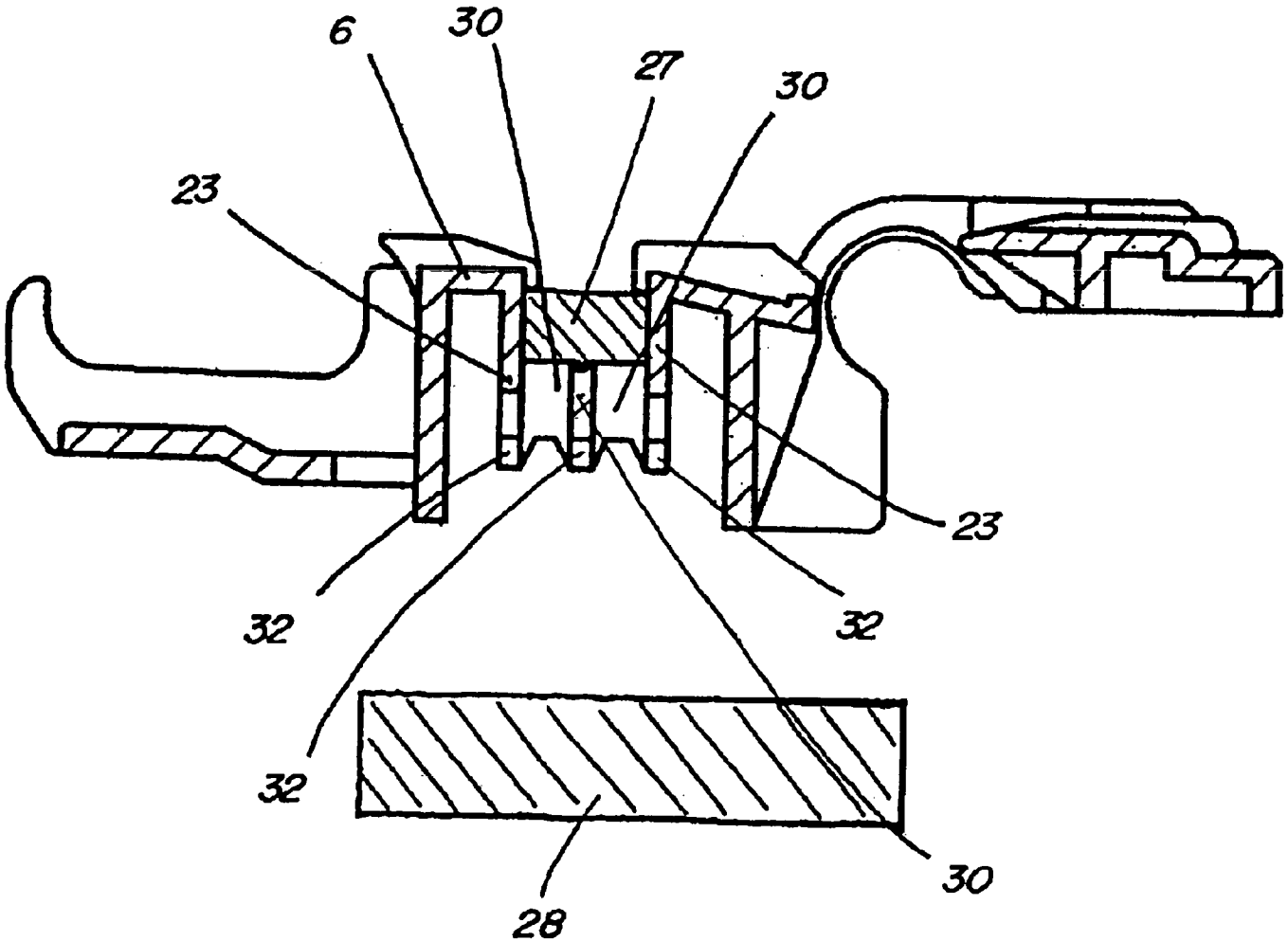
FIG. 5 is a side cross-sectional view showing the portion of the apparatus for recording with no margin in the embodiment of the invention.
Figure 6:
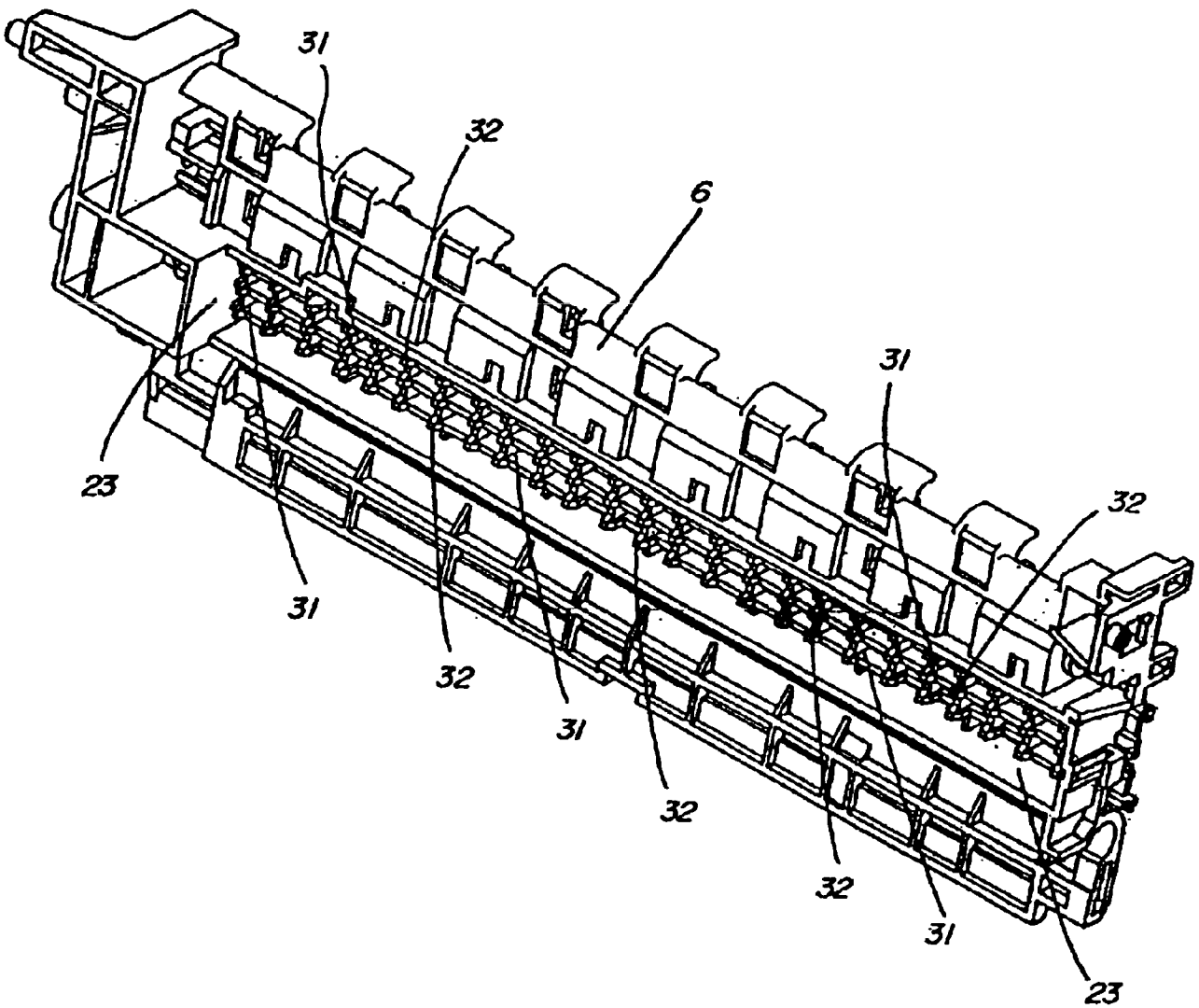
FIG. 6 is a perspective view showing the portion of the apparatus for recording with no margin in the embodiment of the invention.

As shown in FIG. 4 to FIG. 6, the platen ink absorbing material 27 is held on a wall surface 23 extending substantially vertically downward from the opening formed in the top surface of the platen 6 as well as on a top surface of a grid shaped rib 30 extending substantially vertically downward and connecting the wall face 23 at a midway of the wall face 23.

With execution of the recording with no margin, most of ink droplets discharged at a position beyond an edge of the sheet arrive at a surface of the platen ink absorbing material 27. The ink arriving at the platen ink absorbing material 27 gradually sinks downward in the platen ink absorbing material 27 due to its weight. The material of the platen ink absorbing material 27 may be a highly foamed urethane of a low density or the like to improve the ink absorbing property.

The ink accumulating at a lower portion of the platen ink absorbing material 27 moves downward through plural corners 31 (see FIG. 6) formed at the grid shaped rib 30 from the top surface of the grid shaped rib 30 in contact with a bottom surface of the platen ink absorbing material 27 by operation of surface tension forces. The ink reaching the bottom of the grid shaped rib 30 forms droplets, which drop and are absorbed in an apparatus ink absorbing material 28 formed further below. Formation of protrusions 32 at the intersections of the lower surface of the grid shaped rib 30 structurally promotes ink reaching the lower surface of the grid shape rib 30 via the corners 31 to accumulate and drop (see FIG. 5).

Figure 7:
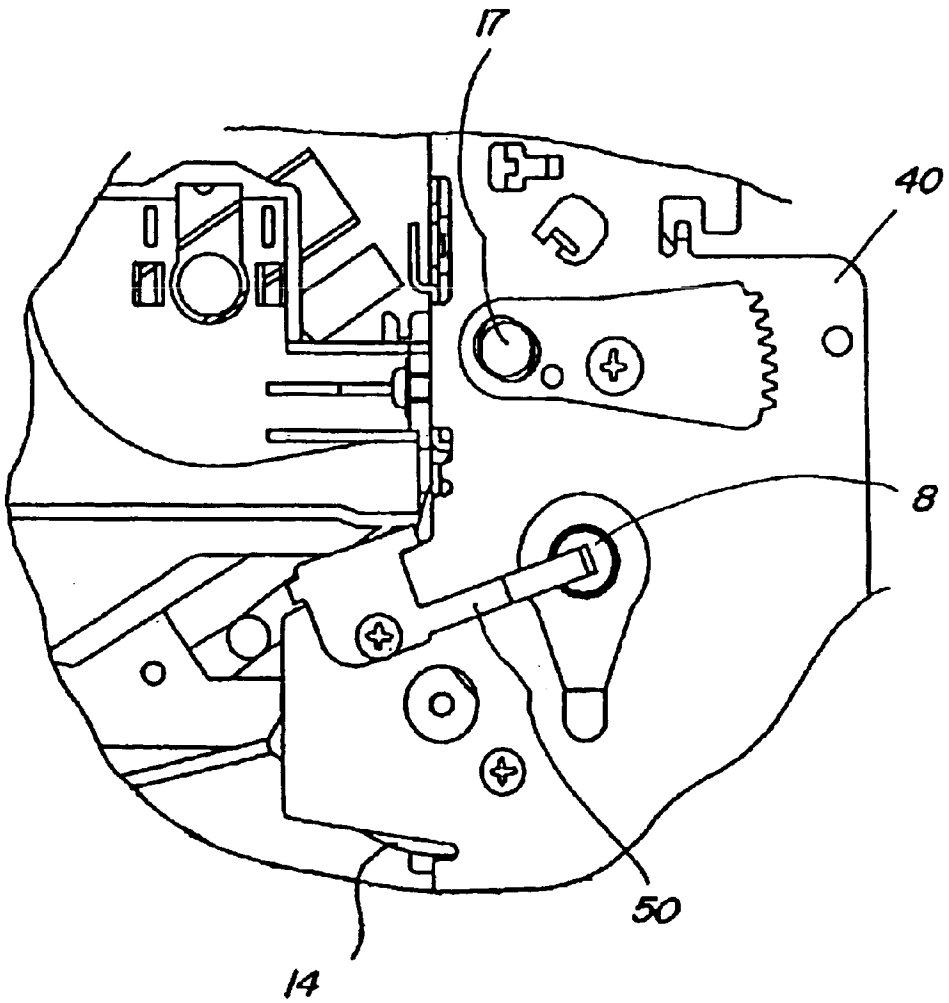
FIG. 7 is a partial, left side view exemplifying a conductive structure between a conveyance roller and a metal chassis in the embodiment of the invention.
Figure 8:
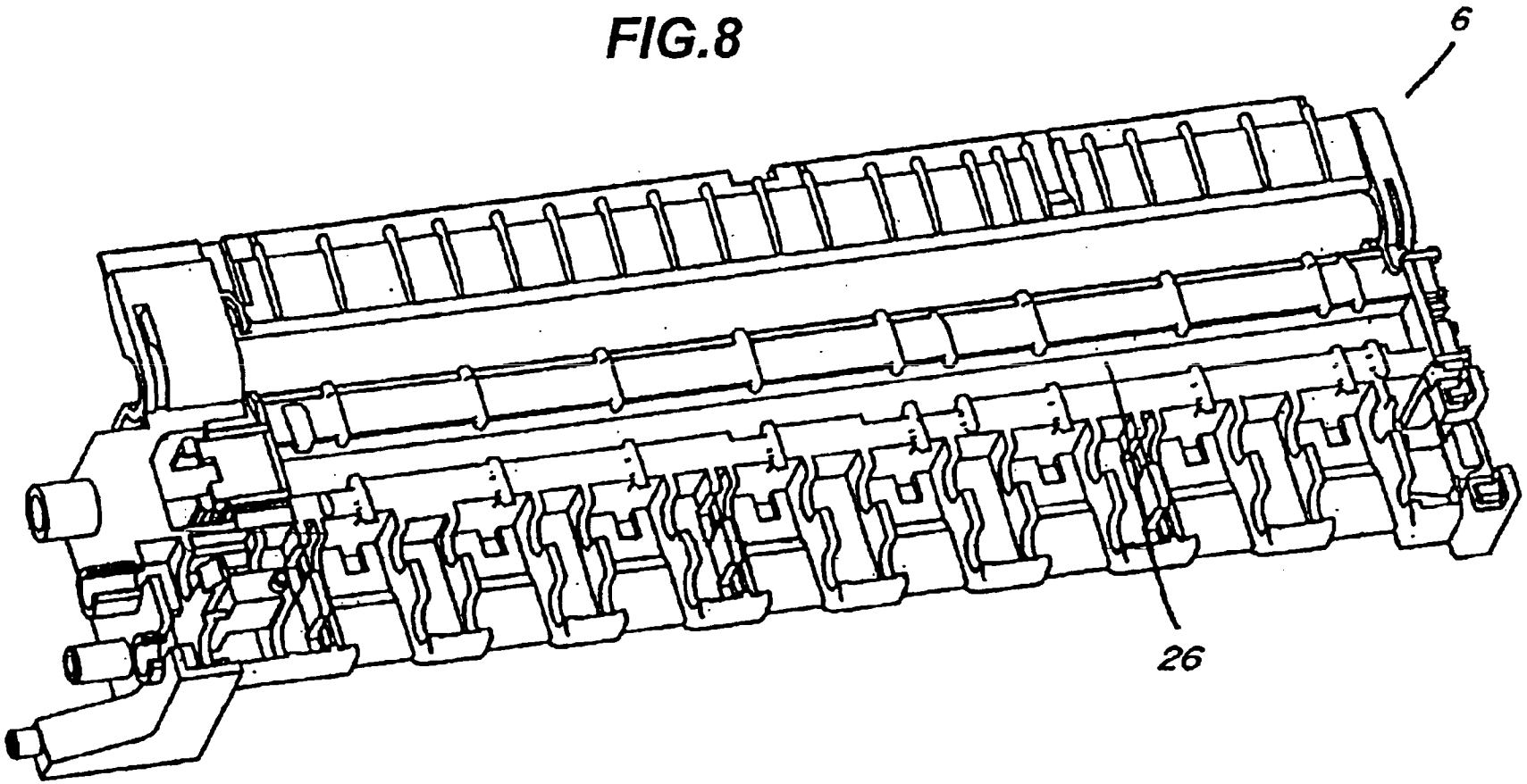
FIG. 8 is a perspective view showing a portion of a prior art apparatus for recording with no margin.
Figure 9:
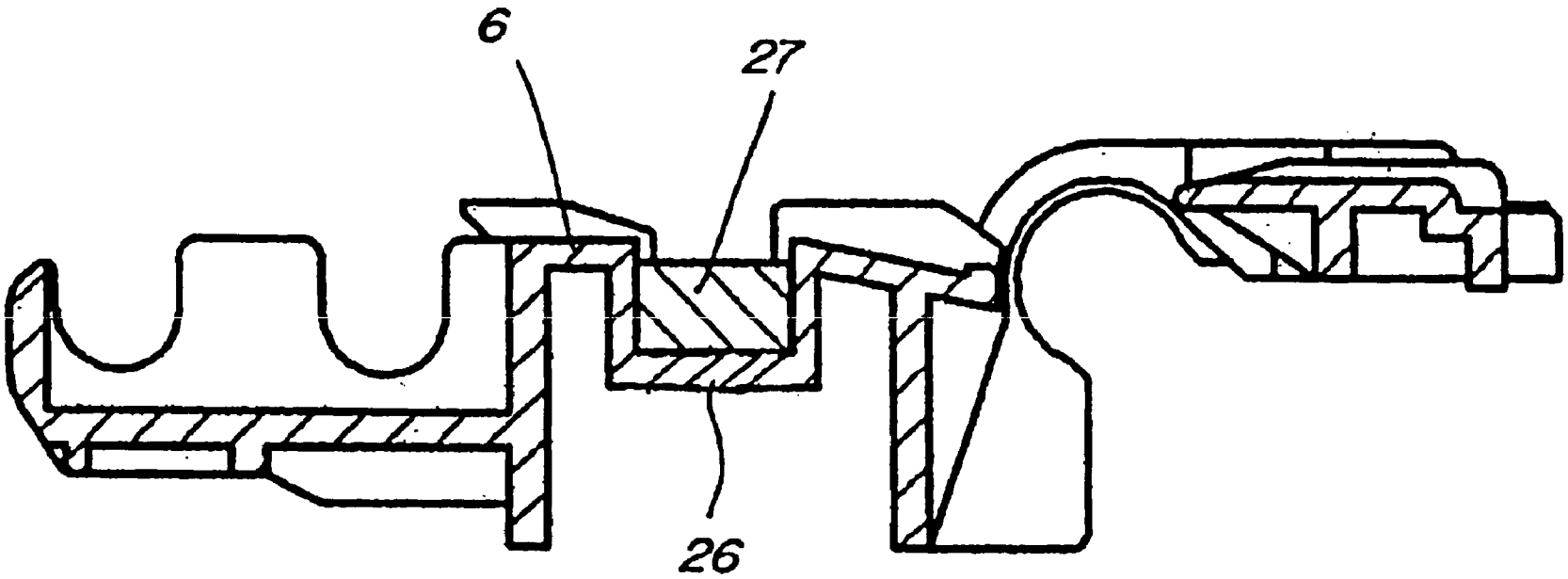
FIG. 9 is a side cross-sectional view showing the portion of the prior art apparatus for recording with no margin.

Furthermore, this embodiment has a structure that the conveyance roller 8, as a conveyance rotary body located on an upstream side, with respect to the recording medium conveyance direction, of the opening of the platen 6, is structured to be made conductive to the metal chassis 40 of the apparatus body. More specifically, as shown in FIG. 7, the conveyance roller 8 is made conductive to the metal chassis 40 of the apparatus body via a grounding spring 50 as a plate shaped conductor. It is to be noted that, in this embodiment, the grounding spring 50 as an urging member (spring member) made of SUS304CSP or the like serving as a plate shaped conductor is exemplified, but this invention is not limited to this.

The grounding spring 50 is attached to the chassis so as to urge the end face of the conveyance roller 8 in a thrust direction, or shaft or axial direction of the conveyance roller 8. The grounding spring 50 is attached to the metal chassis 40 by fastening screws together with other parts attached to the metal chassis 40 (such as the stepping motor 14 as shown in FIG. 7 in this embodiment).

According to the above structure, when a sheet charged with static electricity due to friction among sheets or between the sheets and the feeding rollers is conveyed, the static electricity built up in the sheet passes through the pin holes in the binder material of the conveyance roller 8 and flows from the metal shaft via the grounding spring 50 to the metal chassis 40, thereby removing the static electricity built up in the sheet. Accordingly, a member such is a discharging brush or the like is not necessary to be separately provided for discharging the static electricity from the sheet. This apparatus, though having an inexpensive structure for removing the static electricity from the static electrically-charged sheet, can prevent the sheet from being stained due to attachment on the sheet back side of ink droplets other than those arriving at the surface of the platen ink absorbing material 27 and droplets rebounded at a time of arrival to the platen ink absorbing material 27, from among those droplets discharged to the area extending beyond the sheet during the marginless recording.

Because the grounding spring 50 is made of a leaf spring, the spring 50 can provide a large contact area to the end surface of the conveyance roller 8 in comparison with a wire, so that the conducting state can be stabilized as well as that occurrence of mechanical noises and durability problems during operation can be avoided by dispersing the pressure of the contact portion.

The spring is urged to the end surface of the conveyance roller 8, thereby reducing the load torque on the stepping motor 14 in comparison with the structure that a spring is urged against the outer diameter of the conveyance roller 8, and thereby realizing compact size and easiness in assembling.

[Other Embodiments]

In the embodiment described above, regarding a structure in which the conveyance roller 8 as a conveyance rotary body located on an upstream side of the opening of the platen 6, with respect to the recording medium conveyance direction, is made conductive to the metal chassis 40 of the apparatus body, the structure in which the conveyance roller 8 is made conductive to the metal chassis 40 of the apparatus body by the grounding spring serving as a plate shaped conductor is exemplified, but this invention is not limited to this.

For example, in FIG. 1, where bearing members (not shown) secured to the metal chassis 40 for supporting the opposite ends of the conveyance roller 8 are formed of annealed bearings of iron or copper, or of plastic materials having a higher conductivity upon mixture of carbon or the like, the conveyance roller 8 may be made conductive to the metal chassis 40 of the apparatus body by the bearing members for the roller. With this structure, substantially the same effect as in the first embodiment described above can be expected.

Moreover, with the structure of the conveyance roller, where the binder material coated together with the ceramic material for ensuring the frictional coefficient is made of a non-insulator material such as a metal powder or the like to enable static electricity discharge to the metal chassis 40 from the surface of the conveyance roller 8, substantially the same effect as in the first embodiment described above can be expected.

In the embodiment described above, an inkjet recording apparatus using a single recording head is exemplified, but this invention is not limited to this and is applicable to, for example, a color inkjet recording apparatus using plural recording heads for recording with multicolor ink and a grayscale inkjet recording apparatus using plural recording heads for recording with inks in the same color but different in density, regardless of the number of the recording heads, and the same advantages can be obtained.

As the recording means (recording head), this invention is applicable to, for example, a head of a cartridge type in which the recording head and the ink tank are integral and a structure in which the recording head and the ink tank are made separately and connected with an ink supplying tube, regardless the structure of the recording means and the ink tank, and the same advantages can be obtained.

It is to be noted that in a case where the invention is applied to an ink-jet recording apparatus, it is applicable to an apparatus using a recording means employing an electromechanical converter such as piezo device or the like and, among other advantages, it can achieve some of the same advantages as the ink-jet recording apparatus using a recording means for discharging inks utilizing thermal energy. This is because, with this method, high density and high resolution of recording can be achieved.

This invention is also effectively applicable to a recording head of a full line type having a length corresponding to a maximum width of the recording medium recordable by the recording apparatus. Such a recording head can be of a structure satisfying the length by a combination of plural recording heads, or of a structure of a single recording head formed as a united body. In addition, this invention is effective in a case using a recording head of a serial type described above, a recording head secured to an apparatus body, a recording head of a chip type that is replaceable for allowing an electrical connection to the apparatus body upon being mounted on the apparatus body and allowing ink supply from the apparatus body, and a recording head of a cartridge type in which an ink tank is formed integrally with the recording bead itself.

Regarding the kind and number of the recording heads mounted on the carriage, only one head may be mounted corresponding to a monochrome ink, or plural heads may be mounted corresponding to the plural inks different in recording colors and densities. That is, the recording mode of the recording apparatus need not be of a mode recording only a main color such as black, but the mode can utilize a combination of the plural mounted recording heads, and this invention is applicable to an apparatus for recording with multiple different colors or full color by mixing colors.

As the end product incorporating the inkjet recording apparatus described above, it can be, for example, an image output terminal for an information processing apparatus such as a computer, and further, an inkjet input and output apparatus capable of mounting a scanner or the like other than the recording head onto the carriage, a photocopier in combination with a reader or the like, and a facsimile machine having a transmitting and receiving function.

What is claimed is:

1. A recording apparatus for recording an image by discharging an ink, comprising:

recording means capable of recording to at least one edge of a recording medium without any margin;

a receiving portion for receiving ink droplets discharged at a position extending beyond the recording medium; and a conveyance rotary body located on an upstream side of said receiving portion with respect to a conveyance direction of the recording medium, wherein said conveyance rotary body is made conductive to an apparatus body and said receiving portion is apart from a back side of the recording medium at the at least one edge thereof.

2. The recording apparatus according to claim 1, wherein said receiving portion comprises an opening formed on a face of a platen for supporting the recording medium.

3. The recording apparatus according to claim 1, wherein said conveyance rotary body is made conductive to a chassis of the apparatus body via a plate shaped conductive member.

4. The recording apparatus according to claim 3, wherein the plate shaped conductive member comprises an urging member attached to the chassis so as to urge an end surface of said conveyance rotary body in an axial direction.

5. The recording apparatus according to claim 3, wherein the plate shaped conductive member is attached to the apparatus body via a screw together with another member to be attached to the apparatus body.

6. The recording apparatus according to claim 1, wherein said conveyance rotary body is made conductive to a chassis of the apparatus body via a bearing member of said conveyance rotary body.

7. The recording apparatus according to any one of claims 1 to 6, wherein said conveyance rotary body comprises a conveyance roller formed of a metal shaft coated with mainly ceramic particles together with a binder material.

8. The recording apparatus according to claim 7, wherein the binder material has a structure forming fine pin holes when coated.

9. The recording apparatus according to claim 7, wherein the binder material is formed of non-insulating material.

10. The recording apparatus according to claim 7, wherein the binder material comprises a metal powder.

11. A recording apparatus for recording an image by discharging an ink, comprising:

recording means capable of recording to at least one edge of a recording medium without any margin;

a receiving portion for receiving ink droplets discharged at a position extending beyond the recording medium; and a conveyance rotary body located on an upstream side of said receiving portion with respect to a conveyance direction of the recording medium, wherein said conveyance rotary body is made conductive to a chassis of an apparatus body via a conductive member comprising an urging member attached to the chassis so as to urge an end surface of said conveyance rotary body in an axial direction.

* * * * *

UNITED STATES PATENT AND TRADEMARK OFFICE

CERTIFICATE OF CORRECTION

PATENT NO. : 6,899,411 B2
APPLICATION NO. : 10/427976
DATED : May 31, 2005
INVENTOR(S) : Niikura et al.

It is certified that error appears in the above-identified patent and that said Letters Patent is hereby corrected as shown below:

COLUMN 5
Line 19, "is" should read --as--.

COLUMN 6
Line 44, "bead" should read --head--.

Signed and Sealed this

Twenty-eighth Day of November, 2006

JON W. DUDAS
*Director of the United States Patent and Trademark Office*